US005145095A

United States Patent [19]

Loudon

[11] Patent Number: 5,145,095

[45] Date of Patent: Sep. 8, 1992

[54] DISPENSER FOR DEFORMABLE TUBE PACKAGED SEMI-SOLID PRODUCTS

[76] Inventor: James W. Loudon, 3 Pollock Close, Magalliesig, Sandton, Transvaal, South Africa

[21] Appl. No.: 397,393

[22] Filed: Aug. 23, 1989

[30] Foreign Application Priority Data

Aug. 30, 1988 [ZA] South Africa ..... 88/6426

[51] Int. Cl.[5] ..... B65B 3/00

[52] U.S. Cl. ..... 222/181; 222/341; 141/352; 141/357; 141/360

[58] Field of Search ..... 222/379, 341, 321, 181, 222/185, 490, 513, 545, 340, 320, 190; 141/250, 251, 258, 270, 318, 346, 363-366, 352-354, 357-358, 360, 362; 401/118, 123, 129, 191; 417/514, 552-553

[56] References Cited

U.S. PATENT DOCUMENTS

| | | | |
|---|---|---|---|
| 2,622,539 | 12/1952 | Martin | 222/341 X |
| 2,775,989 | 1/1957 | Jensen | 141/360 |
| 3,211,340 | 10/1965 | Zander et al. | 222/95 |
| 4,269,238 | 5/1981 | Iwamoto | 141/362 |
| 4,303,110 | 12/1981 | Chen | 141/362 |
| 4,474,307 | 10/1984 | Chappell | 222/383 X |
| 4,695,177 | 9/1987 | Kuo | 401/150 |
| 4,826,052 | 5/1989 | Micallef | 222/321 |
| 4,949,877 | 8/1990 | Hanna et al. | 222/185 X |

*Primary Examiner*—Michael S. Huppert
*Assistant Examiner*—Anthoula Pomrening

[57] ABSTRACT

A dispenser for use in dispensing a semi-solid material such as a paste, gel, ointment or the like, from a deformable tube, a particular application being for the dispensing of toothpaste. The product tube is screwed to the dispenser via the threaded throat and bears on one of two non-return valves to create an airtight seal. The tube is squeezed to prime the dispenser and fill the cavity. When a plunger assembly is pressed inward against a spring, product is displaced through the non-return valves and a dispensing nozzle. On release of plunger, the spring returns plunger to its original position and by vacuum action displaces an equivalent amount of product from the tube to replenish product in the dispenser cavity. The dispenser preferably has side flanges and projecting pins for the storage of toothbrushes.

9 Claims, 1 Drawing Sheet

DISPENSER FOR DEFORMABLE TUBE PACKAGED SEMI-SOLID PRODUCTS

This invention is concerned with a dispenser for use in dispensing a flowable semi-solid material from a deformable tube. By the term "semi-solid material" as used herein is meant a material such as a paste, gel, ointment or the like, a particular type of which material is commercially available toothpaste.

According to one aspect of the invention there is provided a dispenser comprising an inlet port to which the throat of a deformable tube containing semi-solid material can be secured, an outlet port through which the semi-solid material can be dispensed, a chamber between the ports, a first one way valve means at the inlet port to permit flow of the material into the chamber and a second one-way valve means between the chamber and the outlet port to permit flow of material from the chamber to the outlet port, and plunger means for varying the volume of the chamber to draw the material from the tube when the said volume is increasing and to dispense the material through the outlet when the said volume is decreasing, there being a passage through the said plunger means through which the said material passes from the chamber to the outlet port.

The said second valve means is preferably provided at the inlet to the said passage. Spring means are preferably provided to urge the plunger means to an outward position so that the volume of the said chamber is at a maximum. The plunger means conveniently has a hollow projection of smaller cross-section through which the passage passes to the outlet port, which is preferably downwardly directed. At the outer end of the plunger means there is preferably provided a push surface against which the end of e.g. a toothbrush may butt to move the plunger means inwardly against the bias of the spring means. A recess is preferably provided in this surface to locate the end of the toothbrush when it is being used so to move the plunger means.

The valve means are preferably lip valves, i.e. valves which are constructed of deformable material, each of which has a generally cylindrical body with a flange at one end and a pair of opposite side faces that converge to a diametrally extending top surface that has a slit therein and which permits flow through the slit from within the body when there is pressure in the body but prevents reverse flow when there is pressure on the outsides of the side faces.

The dispenser is preferably mounted on a mounting surface which can with ease be attached to a permanent surface such as a wall or the like. The mounting surface is preferably provided with side extensions on which projecting pins are preferably formed to carry toothbrushes thereon. The dispenser is preferably a plastics moulding and the mounting surface is preferably integral therewith.

Embodiments of the invention will now be described by way of example with reference to the accompanying drawings.

Figure 1:
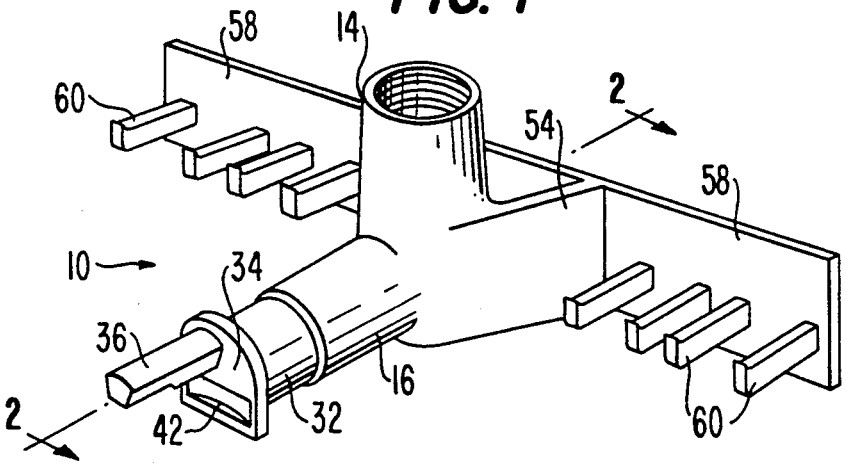
FIG. 1 is a perspective view of the dispenser of the invention.

Referring now to the drawings, there is shown a dispenser 10 for use in dispensing toothpaste, which is a flowable semi-solid material from a deformable tube 12. The dispenser 10 comprises an "L"-shaped body having a vertical tubular member 14 connected at its lower end to a horizontal tubular member 16.

The outer portion 18 of the vertical member 14 forms an inlet port of larger diameter than the lower portion 20 and has internal threads 22. The throat of the deformable tube 12 can be threadedly received in this portion 18 and sealed to the dispenser 10. Between the larger and lower portions 18 and 20 there is a transverse annular surface 24.

An inlet valve 26 in the form of a lip valve is inserted in the vertical member 14. The lip valve 26 has a flange 28 which rests on the surface 24 and a body that extends into the lower portion 20 so that its end surface 30 (that has a slit therein) is near the junction with the horizontal member 16.

Within the horizontal member 16 there is slidably received a hollow tubular plunger 32. The plunger 32 is closed off by a snap-on nozzle 33. The nozzle 33 includes an end wall 34 which extends beyond and below the area of the member 16 and has a narrow projection 36 which has a bore 38 therethrough terminating in a downwardly opening outlet port 40. A recess 42 is formed in the wall 34 for the purpose which will be described below.

At its inner end, the plunger 32 receives a lip valve 44 having its flange 46 resting on the inner annular face 48 of the plunger and sweeping the interior of the portion 16 to seal therewith. The body of the valve 44 is received within the plunger 32. A helical compression spring 50 acts on the plunger 32 through the flange 46 to urge the plunger outwardly.

It will be seen that the space 52 between the two lip valves 26 and 44 constitutes a central chamber for the dispenser. The space between the body of the outlet lip valve 44 and the interior of the plunger 32 and the bore 38 constitutes a passage through the plunger 32.

The dispenser 10 is carried by a "V"-shaped carrier 54 on a mounting surface 56 comprising two side ears 58. Pairs of projections 60 are provided to carry toothbrushes in the usual way. On the rear face of the surface 56 are provided a pair of vertically spaced double sided adhesive tapes 62 whereby the mounting surface can be mounted onto a wall or the like.

The dispenser 10 is a plastics moulding and the mounting surface 52 and carrier 54 are integral therewith. The plunger 32 is also a plastics moulding.

In use, with the dispenser 10 mounted on to a wall 64 of e.g. a bathroom, the throat of the toothpaste tube 12 is screwed into the portion 18 of the vertical member 14 until it seals against the first valve 26. The tube 12 is squeezed so that any air therein is expelled and the toothpaste is forced into the chamber 52 formed in the dispenser 10 between the inlet and outlet valves 26 and 44 until the chamber 52 is filled.

When a user requires to place toothpaste on a toothbrush 66, the end of the toothbrush 66 is placed in the recess 42 butting against the wall 34 and is then moved to push the plunger 32 inwardly against the bias of the spring 50. This movement varies the volume of the chamber 52 by decreasing it and forces the toothpaste in the chamber 52 through the second valve 44 and hence through the passage 38 to be dispensed from the outlet port 40 on to the bristles 68 of the toothbrush. On withdrawing the toothbrush, spring 50 urges the plunger 32 outwardly increasing the volume of the chamber to draw toothpaste from the tube 12. It will be appreciated that (a) the outlet valve 44 prevents toothpaste in the plunger 32 being drawn backwardly into the chamber 52 when the plunger 32 is moving outwardly and (b) the inlet valve 26 prevents toothpaste being forced back into the tube 12 when the plunger 32 is moved inwardly.

Figure 3:
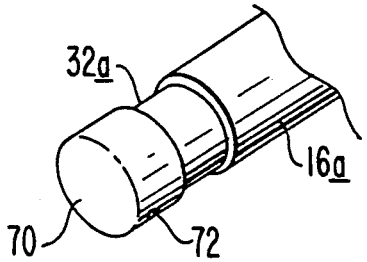
FIG. 3 is a detail of the end of a modified dispenser of the invention.
Figure 2:
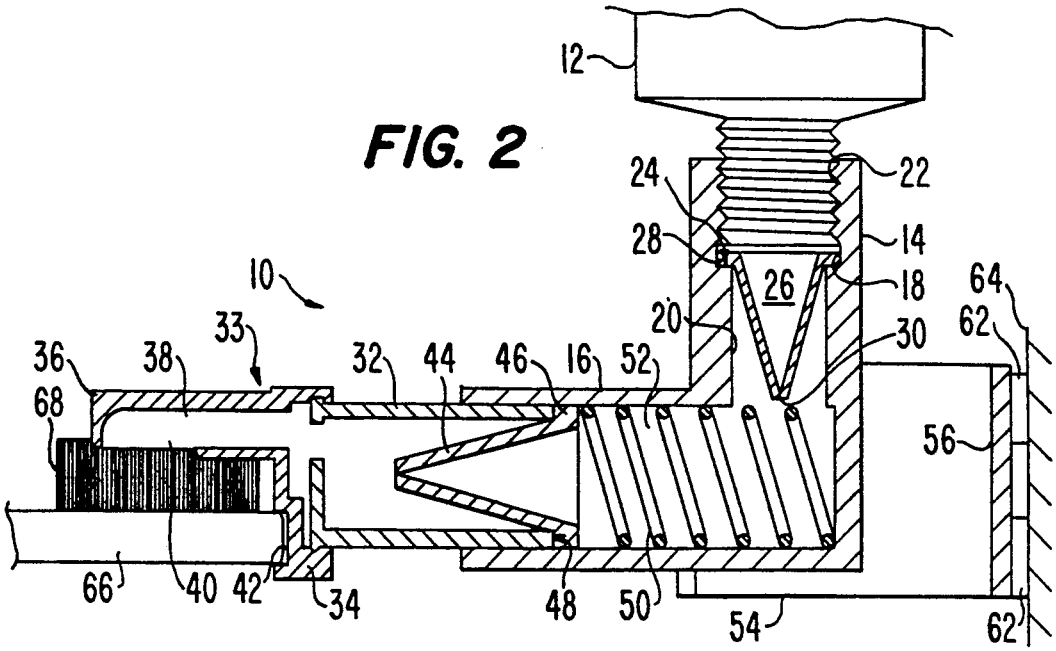
FIG. 2 is a longitudinal section through the dispenser along line 2—2 of FIG. 1.

It will be appreciated that the dispenser may be used to dispense other semi-solid materials contained in deformable tubes such as disinfectant ointments or gels, hand cleaners and the like. A suitable arrangement for this purpose is shown in FIG. 3 where the plunger 32*a* has a snap-on rounded knob 70 at the end which can be engaged by the hand and which has a downwardly directed outlet port 72 through which the semi-solid material will be discharged.

The invention is not limited to the precise constructional details hereinbefore described and illustrated in the drawings. For example, the passage 38 can continue for the entire length of the projection 36 so that the port 40 will be open ended.

I claim:

1. A dispenser for dispensing a semi-solid dentifrice material onto a toothbrush, comprising an inlet port to which a throat of a deformable tube containing the dentifrice material can be secured; an outlet port through which the dentifrice material can be dispensed; a chamber between the ports; first one-way valve means at the inlet port to permit flow of the dentifrice material into the chamber and second one-way valve means between the chamber and the outlet port to permit flow of the dentifrice material from the chamber to the outlet port; plunger means displaceable from an initial position for decreasing the volume of the chamber to dispense the dentifrice material through the outlet port; and spring means for returning said plunger means to said initial position for drawing the dentifrice material from the tube into the chamber by increasing the volume of the chamber; said plunger means having a hollow projection of smaller cross-section at an outer end of which the outlet port is located, the outlet port being generally downwardly directed, a passage with an inlet at which said second valve means is provided and passing from the chamber to the outlet port, and a push surface inwardly disposed from the outlet port and against which an end of the toothbrush may be abutted, with bristles thereof disposed beneath the outlet port, to move the plunger means inwardly against the bias of the spring means and thereby dispense the dentifrice material via said passageway downwardly through the outlet port onto the bristles of the toothbrush.

2. A dispenser as claimed in claim 1 wherein a recess is provided in the push surface to locate the end of the toothbrush when it is being used so to move the plunger means.

3. A dispenser as claimed in claim 1, said spring means being disposed in said chamber.

4. A dispenser as claimed in claim 1 wherein the said first and second valve means are lip valves.

5. A dispenser as claimed in claim 1 wherein the dispenser is mounted on a mounting surface which can with ease be attached to a permanent surface.

6. A dispenser as claimed in claim 5 wherein the mounting surface is provided with side extensions.

7. A dispenser as claimed in claim 6, having projecting pins formed to carry toothbrushes thereon.

8. A dispenser as claimed in claim 7, wherein the dispenser is a plastics molding.

9. A dispenser as claimed in claim 8 wherein the mounting surface is integral with the dispenser.

* * * * *